US005560236A

United States Patent [19]

Onda et al.

[11] Patent Number: 5,560,236

[45] Date of Patent: Oct. 1, 1996

[54] METHOD OF ROLLING AND CUTTING ENDLESS HOT-ROLLED STEEL STRIP

[75] Inventors: Soichiro Onda; Nobuhiro Itoh; Toshio Imazeki; Toshisada Takechi, all of Chiba, Japan

[73] Assignee: Kawasaki Steel Corporation, Japan

[21] Appl. No.: 317,717

[22] Filed: Oct. 4, 1994

[30] Foreign Application Priority Data

Oct. 7, 1993 [JP] Japan ..... 5-251935

[51] Int. Cl.[6] ..... B21B 1/26; B26D 5/20

[52] U.S. Cl. ..... 72/11.8; 72/12.1; 72/203; 72/365.2; 83/27; 228/158

[58] Field of Search ..... 72/203, 206, 234, 72/365.2, 366.2, 11.8, 12.1; 83/37, 27; 228/149, 151, 152, 158

[56] References Cited

U.S. PATENT DOCUMENTS 4,132,342 1/1979 Nitto et al. ..... 72/365.2

4,711,114 12/1987 Rohde et al. ..... 72/203

*Primary Examiner*—Lowell A. Larson
*Assistant Examiner*—Thomas C. Schoeffler
*Attorney, Agent, or Firm*—Austin R. Miller

[57] ABSTRACT

In a rolling and cutting method for an endless hot-rolled steel strip comprising continuous hot rolling and joining rough-rolled slabs to each other with a joint having a boundary between slabs, subjecting the joined rough-rolled strip continuously to hot finish rolling to obtain an endless hot-rolled steel strip with a joint having a boundary between strips, cutting the endless hot-rolled steel strip immediately before coiling, and coiling each cut strip into a coil, the endless hot-rolled steel strip being cut such that the boundary between two successive slabs or sheets is positioned on the radially outermost face of the coil; the target cut point is set relative to the boundary by applying the tracking error of the boundary and the cutting control error for ensuring that the target cut point is accurately positioned on the radially outermost surface of the coil; the strip is kept from breaking at the boundary when coiled, and the coil as a final product can be produced with minimum scrap.

7 Claims, 4 Drawing Sheets

METHOD OF ROLLING AND CUTTING ENDLESS HOT-ROLLED STEEL STRIP

FIELD OF THE INVENTION

The present invention relates to a method of rolling and cutting an "endless" hot-rolled steel strip. The term "endless" is intended to mean especially a composite strip having successive lengths laid end-to-end with a boundary connecting them together.

DESCRIPTION OF THE RELATED ART

Continuous or "endless" hot rolling has been proposed in which steels such as slabs, same or different in size and/or kind, are joined to each other on a hot strip mill line during or after rough rolling, wherein the resulting strip is subjected to continuous finish rolling, and wherein the finished strip is cut into desired or required lengths in accordance with customer orders, followed by coiling into separate coils, one coil for each different size or kind.

A typical layout of an endless hot rolling mill is shown at the top portion of FIG. 1. Successive slabs roughly rolled by a rough rolling mill 1, after passing a shear 3, are moved along in line and joined to each other by a rough-rolled slab joining apparatus 2. The joined strip of successive slabs which differ from each other is rolled continuously to a predetermined thickness by a finish rolling mill 4, cooled by a hot-rolled steel strip cooling apparatus 6, and then cut by a strip shear 7 into individual product coils. Each length of cut strip is passed through coiler pinch rolls 8 and wound up by a coiler 9 having a mandrel 9'.

Steps of such "endless" hot rolling are diagrammatically shown in FIG. 2. Slabs produced according to kind and size of steel are joined to each other through the steps of heating and rough rolling, followed by continuous hot rolling in an "endless" manner with each predecessor slab or strip joined to and followed by its successor. During the steps from joining to cutting as shown in FIG. 2, the joined strip is endlessly rolled under conditions where intermediate products of same or different kinds of steel in different sizes are interconnected. After cutting, the strip is divided into products according to kind and size of steel, and then the divided strips are wound into separate coils.

In the steps of cutting the endless hot-rolled steel strip after finish rolling and coiling, it is required to cut sheets that are different as to kind and size of steel, including thickness and width, at their boundaries, but with minimum waste or yield reduction, and to finish the products as different coils each comprising a single kind of steel in a single size.

To meet these requirements the mill is usually designed to cut the strip by use of a strip shear, attempting to take accurate aim at the boundaries where the different metals are connected to each other, to achieve improved yield.

However, cutting a hot strip moving at extremely high speed causes errors of cut position. These errors are so greatly magnified that the boundary location is sometimes positioned almost at random on a portion of the preceding strip (the leading strip when cut), which portion will become a part of the radially outermost portion of a coil, or sometimes on the portion of the succeeding strip (the following material when cut) that will become a part of the radially innermost part of its coil. It has been found that when the cut is positioned only a short distance away from the boundary to that sheet portion that will become the innermost part of its coil, this may lead to the strip being broken at the boundary due to the effect of a high momentary tension that is imposed upon the boundary portion adjacent the mandrel or between the coiler mandrel 9' and a shear entry pinch roll 5 (FIG. 1) when the leading end of the leading strip portion is wound around the coiler mandrel 9'.

If such a problem occurs, the broken material cannot of course be finished into a useful product and must be treated as scrap, and the mill line must suffer an extensive shutdown. Thus, the use of the endless hot rolling technique, with intended improvement of rolling efficiency, cannot actually be achieved as a practical matter.

On the other hand, the breaking problem does not significantly arise when the joint boundary is positioned accurately near the end of the radially outermost surface of the coil. However, if the boundary is too far away from the strip cut point, the yield of the resulting coil is reduced, since the end strip portion between the boundary and the cut must eventually be scrapped.

Japanese Patent Laid-Open No. 61-14007 and No. 4-28416, for example, attempts to overcome these problems. But these attempts to cut a strip by taking aim at the boundary points are ineffective when errors of cut position are magnified by high-speed rolling.

Japanese Patent Laid-Open No. 61-14007 also discloses a method of cutting and removing a portion of a rolled strip including the boundary by two pairs of high-speed cutters operating in synchronized relation. However, the disclosed method is not mechanically or otherwise adapted for application to a strip that is moving at high speed, and is ineffective in practical use.

SUMMARY OF THE INVENTION

An object of the present invention is to provide a hot-rolled steel strip cutting technique capable of overcoming the problems mentioned above.

It is another object of the present invention to provide a high-speed endless rolled strip cutting method in which the strip is protected from breaking at its boundary when the strip is coiled into a coil. Another object is to provide an endless rolled strip cutting method for producing a hot coil with a minimum of surplus scrap. Other objects of the present invention will be apparent from the following detailed description of the invention.

BRIEF DESCRIPTION OF THE INVENTION

The present invention provides a rolling and cutting method for an endless hot-rolled steel strip having successive lengths laid end-to-end with intervening boundaries, comprising continuous hot rolling steps of joining rough-rolled slabs to each other joined end-to-end before hot finish rolling, subjecting a joined rough-rolled strip continuously to hot finish rolling to obtain an endless hot-rolled steel strip having sections joined by boundaries, cutting the endless hot-rolled steel strip at or adjacent the boundaries before coiling, and coiling each cut strip into a separate coil, wherein the endless hot-rolled steel strip is cut at such a location that the boundary between two successive slabs or strips is positioned on the outermost surface of the coil.

An important feature of the present invention is to establish a target cut location based on tracking error of the boundary portion and a cutting control error for ensuring that the target cut point is accurately positioned adjacent the boundary material and wherein the boundary material is accurately positioned on the outermost surface of the coil.

Many other advantages of the present invention are set forth in the following description and the drawings.

DETAILED DESCRIPTION OF PREFERRED EMBODIMENTS

Embodiments of the present invention will hereinafter be described in detail with reference to specific forms of the invention, but specific terms used in the specification are not intended to limit the scope of the invention which is defined in the appended claims.

Figure 1:
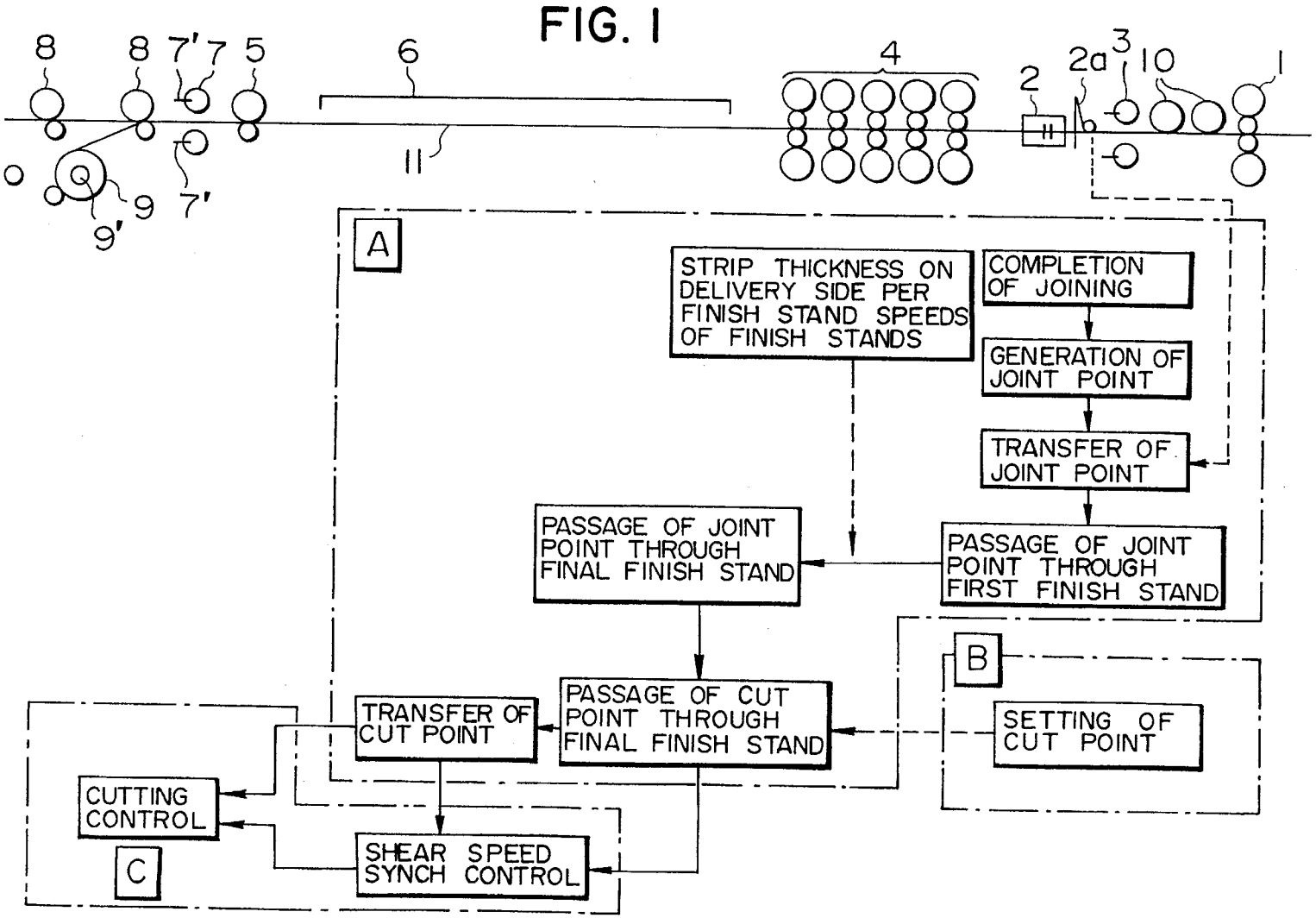
FIG. 1 is a schematic diagram of a production line and a block diagram of an apparatus for tracking boundaries, determining cut points, and cutting a strip continuously at predetermined positions in accordance with this invention.
Figure 2:
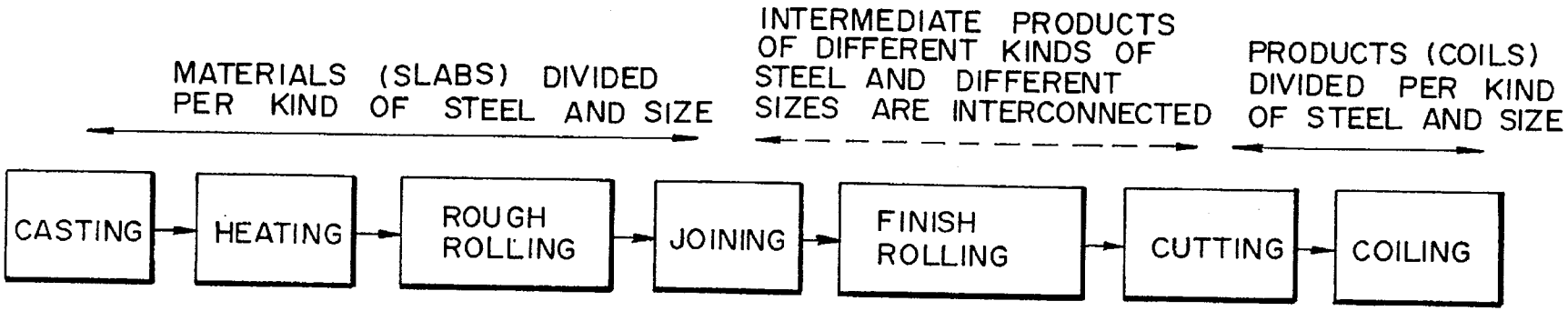
FIG. 2 is a block diagram of a series of steps for endless hot rolling, the diagram also showing the conditions of materials and products, i.e., how they are interconnected or cut or divided.

FIG. 1 includes a block diagram of an apparatus for tracking boundaries, determining cut points, and cutting a strip at predetermined positions.

In FIG. 1, the number 1 represents a rough rolling mill, 2 is a rough-rolled slab joining apparatus for joining successive different slabs endwise to each other, 2*a* is a slab speed detector, 3 is a shear, 4 is a finish rolling mill, 5 is a shear entry pinch roll, 6 is a strip cooling apparatus, 7 is a strip shear, 8 is a coiler pinch roll, 9 is a coiler, 9' is the coiler mandrel, 10 is a coil box, and 11 is a transfer table.

Figure 4:
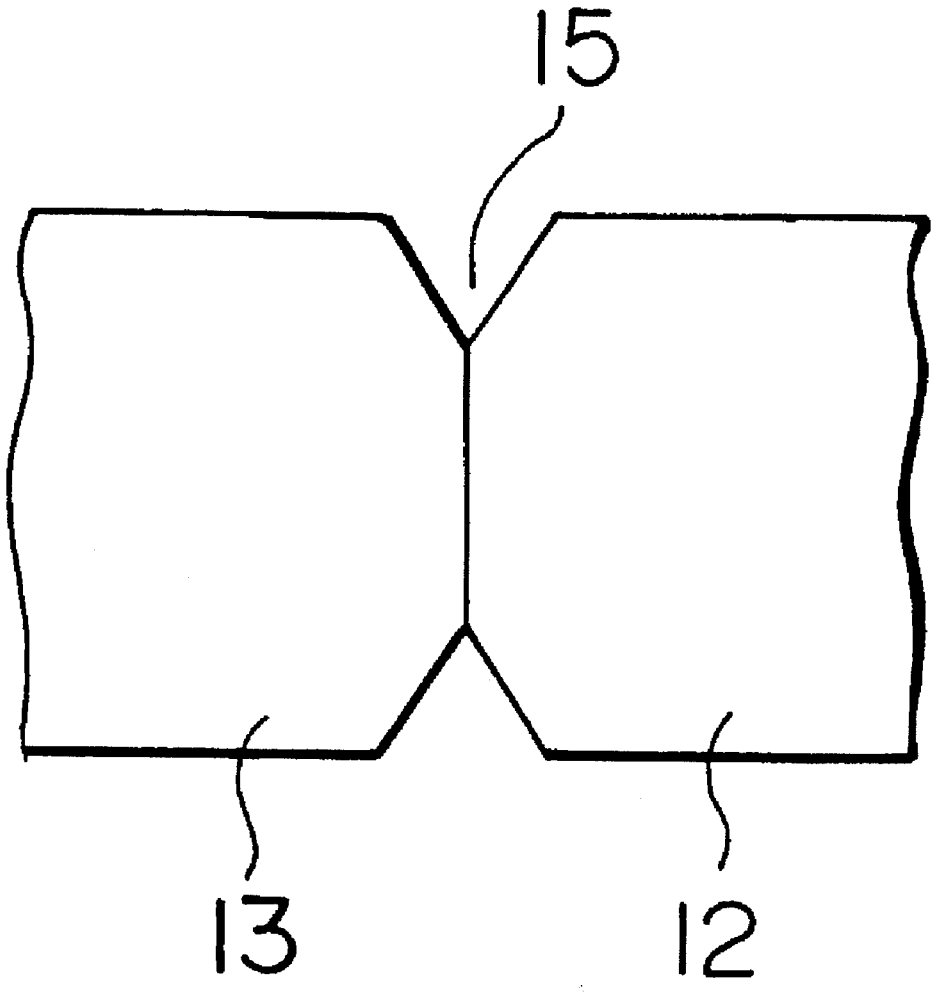
FIG. 4 is a fragmentary view showing a typical configuration of a boundary in accordance with one embodiment of the invention.

Referring to FIG. 4, 12 is a preceding slab, and 13 is a following or succeeding slab.

Returning to FIG. 1, a slab roughly rolled by the rough rolling mill 1 is stored in the coil box 10 and is unwound as needed for delivery to the next step of finish rolling. After being unwound from the coil box 10, the leading end of the succeeding slab 13 (FIG. 4) is joined endwise to the tail end of the preceding slab 12 by the rough-rolled slab joining apparatus 2.

The time and place of joining at that time is input into a computerized tracking apparatus A to generate a computer entry defining the exact position of the boundary point 15 (FIG. 4) between the rough rolled slabs 12, 13. The joined rough rolled slab is forwarded in a downstream direction under control of the slab speed detector 2*a* (measuring roll), and is thereby caused to pass through the first of a series of finish stands 4.

The precise position of each boundary point as it passes through the finish rolling mills 4 is determined from time to time by computerized determinations based upon strip thicknesses on the delivery side of respective finish stands and the running speeds of the finish stands. The computer functions and connections themselves do not require detailed description as they are well known to persons skilled in the computer art.

After the boundary position has been tracked through the computer process and has passed the final finish stand 4, the tracking apparatus A (FIG. 1) generates a target cut point at the position of the final finish stand to form a steel sheet having the desired length as instructed by the memory bank of a host computer B. This is preferably done at the time the boundary position emerges from the final finish rolling mill 4.

The target cut point moves along the transfer table 11 in terms of computer process, based on the known actual value of the circumferential roll speed of the final finish stand 4. The transfer speed of a steel sheet 1.0 mm thick on the transfer table 11, for example, is about 1000 mpm. The strip is then accurately cut by the strip shear 7, taking precise aim at the correct target cut point, pursuant to the computer instructions.

Since the positions of boundaries between successive sheets are transferred by the tracking apparatus A through computerized calculations as described above, there is a difference between the position of the boundary in the tracking apparatus A, i.e., the computer, and the actual position of the boundary. When determining the target cut point with respect to the boundary in the tracking apparatus A, therefore, any error between the computer's calculated position and the actual position of the boundary must be taken into consideration.

After generating the target cut point, an error is also likely to be generated as the boundary location reaches the strip shear 7. This is because the target cut point is moved on the transfer table 11 through calculations in the tracking apparatus A, i.e., the computer.

In the cutting control apparatus C (FIG. 1), further error is likely to occur between the target cut point determined by the computer and the actual cut point, because of inevitable variations in shear speed control and cutting control.

It has been found that there is a standard deviation of the difference between the target cut point determined by the computer in the tracking apparatus A and the target cut point determined by the actual boundary, and that it can be expressed as $\sigma_{TRK}$ in millimeters.

It has also been found that there is a standard deviation of the difference between the target cut point location determined by the computer in the cutting controller C and the actual cut position, and that this can be expressed as $\sigma_{SH}$ in millimeters.

The standard deviations of the above two differences make up the actual error between the actual position and the initially scheduled position of the cut point. The standard deviation of the cut position error may be represented as $\sigma_C$ in millimeters.

The relationship between the errors (represented by the standard deviations of the respective position differences) is expressed by:

$$\sigma_C=(\sigma_{TRK}^2+\sigma_{SH}^2)^{1/2}$$

Accordingly, the target cut point can be controlled to a position shifted in the upstream direction by a distance of $\alpha\times\sigma_C$ using $\sigma_C$ as determined above. In the above equation, $\alpha$ is the adjustment coefficient. Since the error generally appears in the form of normal distribution, $\alpha$ may be set to a specific number such as about 3, for example, i.e., $\alpha=3$, for ensuring that the cut position will always be located upstream of the boundary instead of downstream of the boundary.

The strip (steel sheet) is cut by the strip shear as follows, taking precise aim at the target cut point thus determined.

The strip shear 7 is connected to be responsive to the commands of a strip shear controller C for effecting shear speed control and cutting control as described above. The strip shear comprises a rotary shear having cutter blades 7' provided on upper and lower relatively rotating drums. In this case, the target cut point is aligned with the position where the cutter blades confront each other. The speed of each rotating drum of shear 7 is preferably controlled so that the circumferential speed of the rotating drum is about equal to the transfer speed of the steel sheet.

When the programmed target cut point reaches a position upstream of the strip shear 7 by a predetermined distance (about 20 m, for example, when the transfer speed of the steel sheet is about 1000 mpm), the upper and lower drums are relatively rotated to reduce the distance therebetween so that the upper and lower cutter blades 7', 7' overlap each other to cut the steel sheet.

Although the foregoing description was based upon a cut position determination method wherein the boundary location generated in the joining apparatus was tracked in a computer process, the method is not necessarily so limited.

Figure 3:
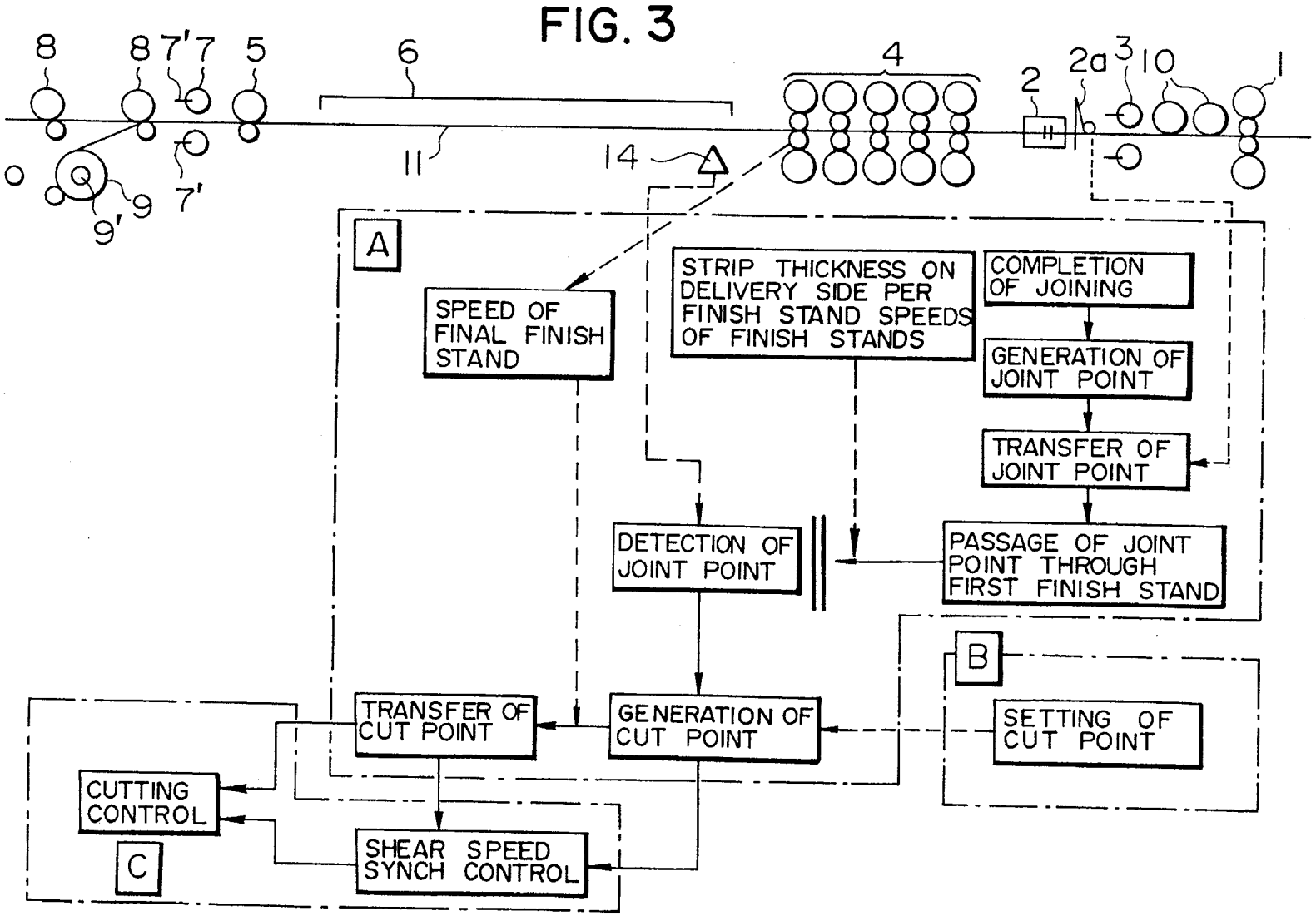
FIG. 3 is a drawing similar to FIG. 1 showing an alternative embodiment of the present invention.

As appears in FIG. 3, as another example, a boundary point sensor 14 may be disposed on the transfer table 11 near the delivery end of the finish rolling mill 4, and the detected boundary point may be tracked by computer so as to determine the cut point, followed by precision cutting of the steel sheet. In this embodiment, the boundary portion between successive slabs 12, 13 (FIG. 4) may be formed with notches 15 as shown in FIG. 4, enabling the boundary location to be easily detected by the sensor 14.

In the present invention as described above, by shifting the target cut point from the error-free calculated boundary point by $\alpha \times \sigma_C$ and setting $\alpha=3$, it is possible to position with certainty the boundary portion of the strip on the radially outermost surface of the coil and to statistically minimize the amount of surplus strip portion which is composed of a different kind or size of steel and is located between the cut point and the boundary on the radially outermost surface of the coil.

According to the present invention, since each boundary of a strip undergoing continuous hot rolling is positively positioned on the radially outermost surface of each product coil and adjacent to its trailing end, the strip can be prevented from breaking at the boundary due to excessive tension caused when the leading end of the hot-rolled steel strip is suddenly engaged and rapidly wound around the coiler mandrel 9'. This leads to great improvement of availability factor and yield of the mill line. Also, since the boundary portion is always located on the radially outermost face of each hot coil, the excess metal comprising a different kind or size of steel can easily be removed before the coil is used.

Although this invention has been described with reference to specific forms of apparatus and method steps, equivalent steps may be substituted, the sequence of steps of the method may be varied, and certain steps may be used independently of others. Further, various other control steps may be included, all without departing from the spirit and scope of the invention, which is defined in the appended claims.

Further, this invention is, for example, explained about cases of joining and cutting different kind of and different size of steels, but is not limitted to the above-described cases. This invention is also applicable to cases of joining and cutting same kind of and same size of steel slabs.

What is claimed is:

1. A method for rolling, cutting and coiling a continuous hot-rolled steel strip, comprising:

joining rough-rolled slabs to each other to form a rough-rolled strip of joined slabs having a boundary between each of said joined slabs;

subjecting said rough-rolled strip continuously to hot finish rolling to produce an endless hot-rolled steel strip having a boundary between each of said joined slabs;

cutting said endless hot-rolled steel strip to separate said joined slabs into successive strips, said cutting being positioned and performed such that said boundary between each of said joined slabs is positioned adjacent to and downstream of said cutting; and coiling each of said successive strips having said boundary into a coil, such that each coil has a radially outermost coil face on which said boundary is located.

2. A method according to claim 1, including the step of determining a target cut point on said strip dependent upon tracking error of said boundary, and upon known error caused in cutting control.

3. In a method of making separate strip coils from a composite strip having successive lengths laid end-to-end with boundaries between said lengths, the steps which comprise:

continuously hot rolling and joining rough-rolled steel slabs to each other, followed by hot finish rolling to form a rough-rolled strip, with a boundary at a location between each of said slabs, subjecting said joined rough-rolled strip continuously in a downstream direction to hot finish rolling to produce an endless hot-rolled steel strip, cutting said endless hot-rolled steel strip, and coiling said cut strip into a coil, generating a positional notation in a tracking apparatus of each said boundary corresponding to the location between said slabs, moving said boundary to a first finish stand in response to a slab speed detector, moving said boundary location in a finish rolling mill based in response to detected strip thicknesses in said finish rolling mill and speeds of said rolls, and causing said tracking apparatus to generate a target cut point downstream of said finish rolls, all at the time said boundary passes said finish rolls, said target cut point being controlled to be positioned upstream of said boundary.

4. A method according to claim 3 wherein said target cut point is compensated by an allowance that is about three times the value of a standard deviation of cut position error due to cut position error arising in said tracking apparatus and cut position error caused by strip shear.

5. A method according to claim 3, wherein said boundary location is generated in said tracking apparatus, instead of when said rough-rolled slabs are joined to each other, by causing a position sensor to detect said position of said boundary upstream of said finish rolls.

6. A method according to claim 5 wherein said target cut point is compensated by an allowance that is about three times the value of a standard deviation of cut position error due to cut position error arising in said tracking apparatus and cut position error caused by strip shear.

7. In a high-speed method of making successive coils from lengths of steel strip of different kinds or sizes from a composite hot strip having successive lengths laid end-to-end with boundaries therebetween, and wherein said composite hot strip is continuously run in a downstream direction and cut on the run at a point at or near each of said boundaries to form individual lengths to be coiled, the steps which comprise:

(a) detecting a position of each of said boundaries on the run prior to said cutting step, and (b) controlling on the run said point of cutting, causing said point to be located spaced upstream of each of said boundaries, and (c) coiling each cut length of strip.

* * * * *